US009278292B2

(12) United States Patent
Vance et al.

(10) Patent No.: US 9,278,292 B2
(45) Date of Patent: Mar. 8, 2016

(54) MOVING SHOW DOOR

(71) Applicant: Universal City Studios LLC, Universal City, CA (US)

(72) Inventors: Eric A. Vance, Ocoee, FL (US); Eric L. Hunt, Orlando, FL (US); Dale Mason, Orlando, FL (US); Keith McVeen, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 14/300,941

(22) Filed: Jun. 10, 2014

(65) Prior Publication Data

US 2015/0352452 A1 Dec. 10, 2015

(51) Int. Cl.

| | |
|---|---|
| ***A63G 31/00*** | (2006.01) |
| ***A63G 31/16*** | (2006.01) |
| *G09G 5/00* | (2006.01) |

(52) U.S. Cl.

CPC ..... *A63G 31/16* (2013.01)

(58) Field of Classification Search

CPC ..... A63G 1/30; A63G 1/34; A63G 31/00; A63G 31/16; G09G 5/00

USPC ..... 472/13, 43, 59, 60, 61, 117, 128, 130, 472/75–80; 345/1.1–4, 31

See application file for complete search history.

(56) References Cited

U.S. PATENT DOCUMENTS

| | | | | |
|---|---|---|---|---|
| 3,442,508 | A | 5/1969 | Rudas | |
| 3,754,756 | A * | 8/1973 | Szigety | 472/75 |
| 5,685,778 | A * | 11/1997 | Sheldon et al. | 472/43 |
| 5,833,544 | A | 11/1998 | Corbin et al. | |
| 5,868,628 | A * | 2/1999 | Drobnis et al. | 472/81 |
| 6,796,908 | B2 * | 9/2004 | Weston | 472/43 |
| 7,905,790 | B2 * | 3/2011 | Schnuckle | 472/43 |
| 8,179,337 | B2 * | 5/2012 | Wilzbach et al. | 345/2.3 |
| 8,905,852 | B2 * | 12/2014 | Geylik | 472/43 |
| 2007/0009861 | A1 | 1/2007 | Heinrich | |
| 2009/0084285 | A1 | 4/2009 | Verl et al. | |
| 2010/0053029 | A1 | 3/2010 | Wilzbach et al. | |
| 2010/0062866 | A1 | 3/2010 | Schnuckle | |
| 2010/0160054 | A1 | 6/2010 | Henry | |

FOREIGN PATENT DOCUMENTS

| | | |
|---|---|---|
| CN | 101428182 A | 5/2009 |
| JP | 2014000169 | 1/2014 |

OTHER PUBLICATIONS www.vimeo.com/75260457; online. Accessed Apr. 17, 2014. 1pg.

PCT International Search Report and Written Opinion dated Sep. 15, 2015.

* cited by examiner

*Primary Examiner* — Kien Nguyen

(74) *Attorney, Agent, or Firm* — Fletcher Yoder, P.C.

(57) ABSTRACT

A ride attraction system utilizes a robotic actuation system to move a curved door of a curved enclosure wall between a first position and a second position via a compound trajectory. In the first position, the door is mated with the wall, and in the second position, the door leaves an opening in the wall. The door and the wall may both include display surfaces that enable images to be displayed to occupants of a ride moving toward the wall and through the opening.

23 Claims, 5 Drawing Sheets

MOVING SHOW DOOR

BACKGROUND

The present disclosure relates generally to a system and method for enhancing a ride attraction and, more particularly, to a system and method for displaying images on a movable door.

Theme or amusement park ride attractions have become increasingly popular. Amusement rides generally include ride vehicles travelling along a path (e.g., a railway or a track), rides that are fixed relative to the ground, or both. In moving rides, the path traveled by the ride vehicles may be situated in different surroundings (e.g., on a mountain top, in a tunnel, under the water). Along the path, there may be different types of show events, such as visual effects, sound effects, water effects, and so forth.

As an example, a moving passenger platform (i.e., a ride vehicle) may travel along a pathway (e.g., a rail) including custom-designed surroundings associated with the ride. The passenger platform may pass through an area having props, such as motorized animals or creatures (e.g., dinosaurs), robots, other vehicles, and so forth. These props can be combined with other effects, such as fires, explosions, and the like, to enhance the realism or immersive nature of the ride. Further, some surroundings may be real environments, such as an aquarium with aquatic life, a small jungle-like environment with foliage and animals, or similar environments.

While these simulated environments can be very effective at creating a pleasurable experience for the rider, these attractions may be subject to further improvement. For example, it may be desirable to enhance the riders' immersion into the simulated environment by moving the riders through sections of an amusement ride divided into sections by various walls. Further, it may be desirable to enhance the effect of transitioning between these different sections to make the experience more pleasurable for the rider. For example, it may be desirable to make the rider feel as if they have been transported into another world by enhancing a transition from one area of an amusement ride to another, separated area.

BRIEF DESCRIPTION

Certain embodiments commensurate in scope with the originally claimed subject matter are summarized below. These embodiments are not intended to limit the scope of the disclosure. Indeed, the present disclosure may encompass a variety of forms that may be similar to or different from the embodiments set forth below.

In accordance with one aspect of the present disclosure, a ride attraction system includes a ride vehicle configured to transport passengers along a path; a screen having a resting position in which the screen occupies the path, wherein the screen comprises a display surface configured to display an image to the ride vehicle along a portion of the path; an actuation system physically coupled to the screen and configured to move the screen from its resting position and along a compound trajectory comprising at least one translation and at least one rotation; and a control system in communication with the actuation system and comprising one or more processing devices configured to cause the actuation system to move the screen from its resting position along the compound trajectory and out of a clearance envelope of the ride vehicle as the ride vehicle approaches the screen and passes the resting position vacated by the screen.

In accordance with another aspect of the present disclosure, a method includes moving a ride vehicle along a path; displaying an image in a display direction toward the ride vehicle using a screen; occupying a forward section of the path with the screen during a first portion of the movement of the ride vehicle along the path, wherein the screen is in a resting position during the first portion of the movement of the ride vehicle such that the ride vehicle approaches the screen; moving the screen along a first compound trajectory using a robotic actuation system coupled to the screen, the movement of the screen along the first compound trajectory occurring during or before a second portion of the movement of the ride vehicle along the path such that the ride vehicle passes the screen without touching the screen, and wherein the first compound trajectory comprises at least one translation and at least one rotation; and moving the screen along a second compound trajectory once the ride vehicle has passed the screen, wherein the second compound trajectory moves the screen to the resting position.

In accordance with another aspect of the present disclosure, a system includes a path of travel; a curved wall including an opening through which the path extends; a ride vehicle positioned on the path and configured to move along the path into an enclosure including the curved wall; a screen having a curved geometry corresponding to the opening in the curved wall, the screen being coupled to a robotic actuation system having a robotic actuator comprising between four and six degrees of freedom, the robotic actuation system being configured to move the screen between a first position and a second position, wherein in the first position the screen fills the opening to form a portion of the curved wall and occupies the path of travel with respect to the ride vehicle, and in the second position the screen is removed from the opening such that the screen does not occupy the path of travel with respect to the ride vehicle; and a projection system having one or more projection devices and configured to project an image onto a surface of the curved wall and a surface of the screen.

DRAWINGS

These and other features, aspects, and advantages of the present disclosure will become better understood when the following detailed description is read with reference to the accompanying drawings in which like characters represent like parts throughout the drawings, wherein.

Figure 1:
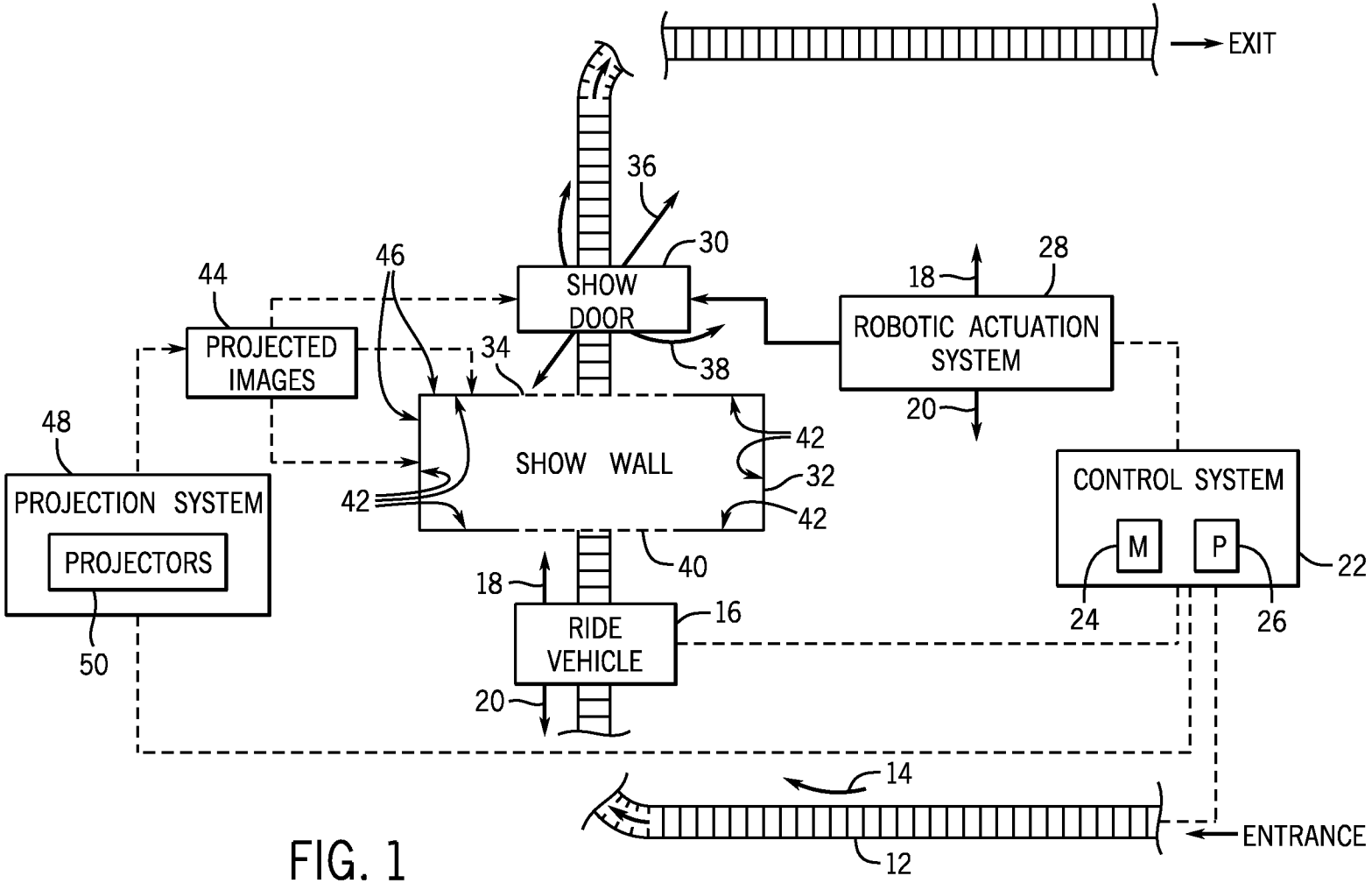
FIG. 1 illustrates an embodiment of a ride attraction system including a show wall with a show door movable via a robotic actuation system, a projection system configured to project images onto the show wall and the show door, and a control system that controls the operation of the various features of the attraction system, in accordance with an aspect of the present disclosure.
Figure 3:
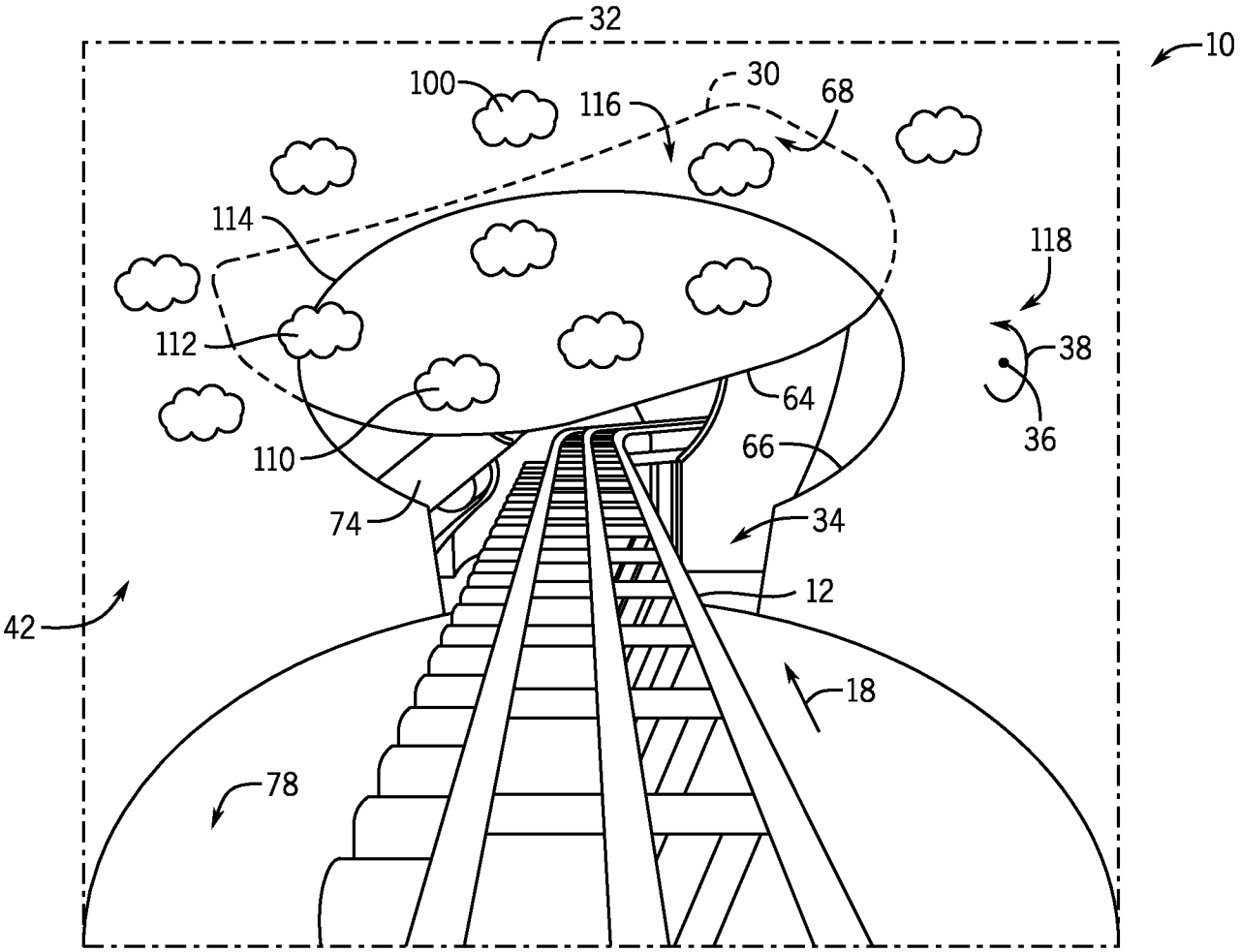
Figure 4:
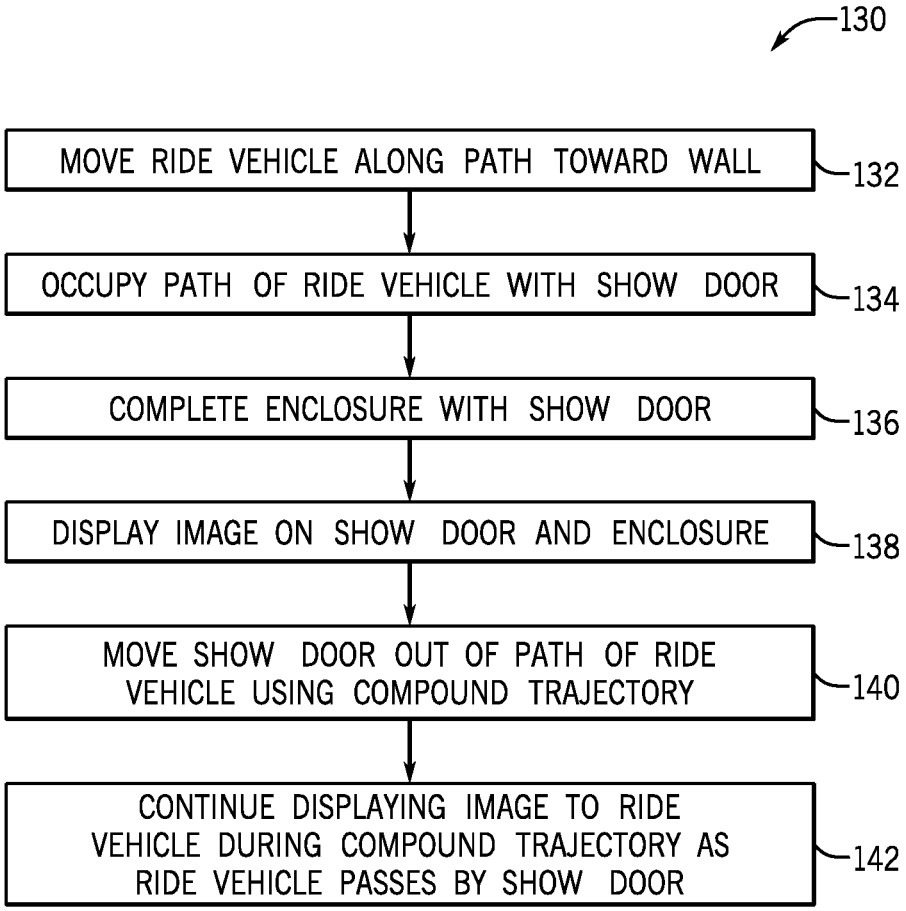
Figure 5:
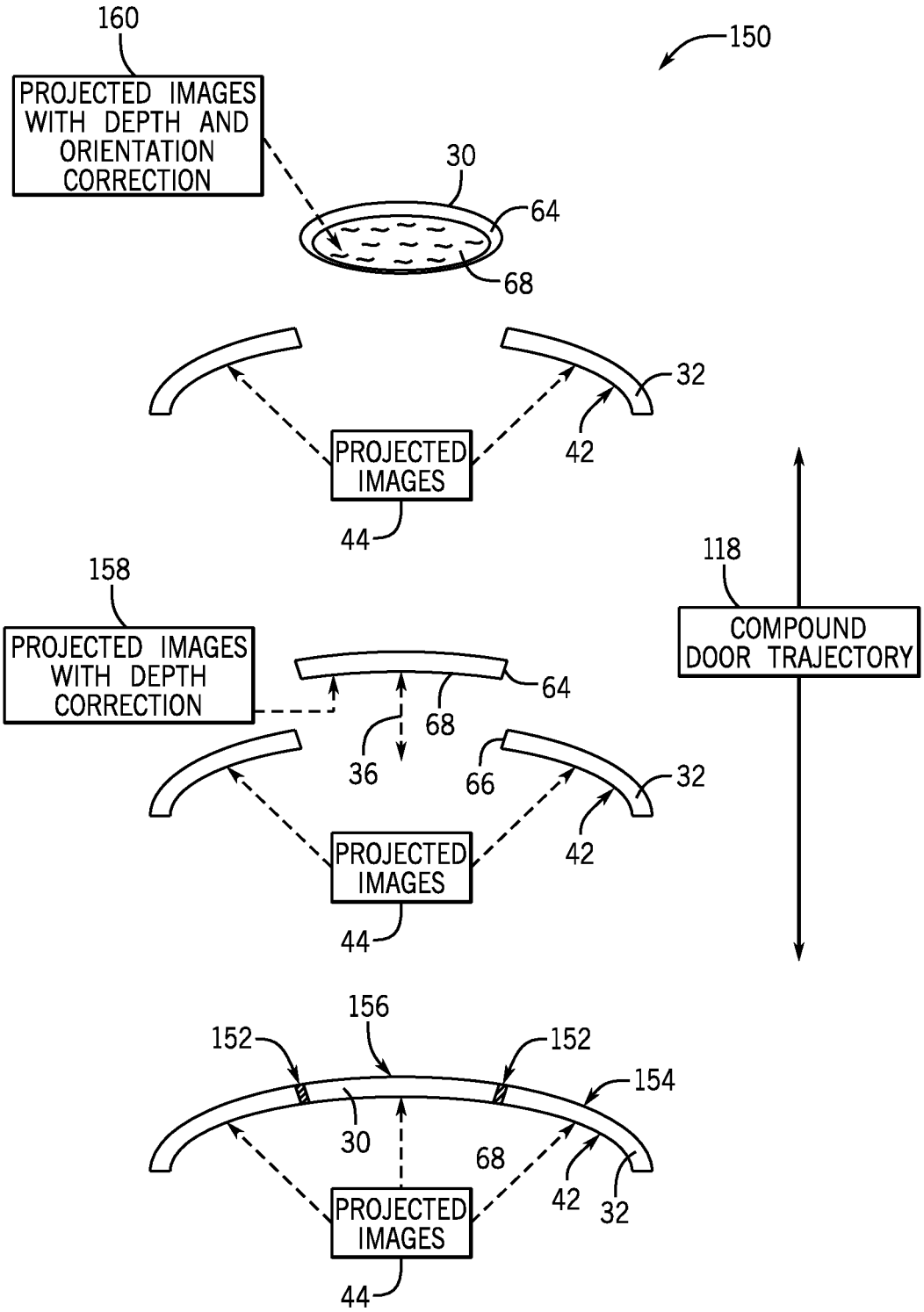

FIG. 3 illustrates a perspective view of an embodiment of the ride attraction system of FIG. 1 from a perspective in front of a display screen, wherein a robotic mechanism of the robotic actuation system has moved the show door out of the path of the ride vehicle, and the show door and show wall are continuing to display images in the direction of the ride vehicle, in accordance with an aspect of the present disclosure;

FIG. 4 is a process flow diagram illustrating an embodiment of a method of operating the ride attraction system of FIG. 1, in accordance with an aspect of the present disclosure; and FIG. 5 is a scheme depicting views of the show door in various spatial relationships with the show wall including a mated relationship and relative positions after a translation and rotation of the door relative to the wall, in accordance with an aspect of the present disclosure.

DETAILED DESCRIPTION

In certain amusement park attractions, guests are able to walk or ride through an area that includes various show features, such as images, props, or the like. In an aspect of the present disclosure, such an area may include a full or partial enclosure having one or more walls themed to look like a house, a tunnel, a mine, a school, a room, or another structure in which a guest may enter. In an embodiment, at least one of the walls may include a complex (e.g., irregular) surface or combination of surfaces used to display images to the guest to enhance the guest's feeling of immersion into a simulated environment. Such a wall may be referred to as a "show wall," where at least a portion of the wall acts as a display screen. For instance, the wall may curve to form a partial or full dome in which the guest may be positioned. As another example, an enclosure may include some linear or irregular walls and a curved display surface that is utilized to simulate a seemingly immersive surrounding. The wall may be a partial enclosure that covers, for example, sections of a path that are within a view of a rider within a ride vehicle, or may be or combine with other walls to form a full enclosure completely encompassing all potential view directions. However, the present disclosure is also applicable to arrangements where a show wall is not curved (e.g., is straight). In such embodiments, the show wall does not necessarily form an enclosure by itself, but may be a part of an enclosure or may be a freestanding wall.

While it is now recognized that such a wall (e.g., a freestanding wall, or a partial or total enclosure) may provide an enhanced experience for the guest, it is also presently recognized that in certain situations, doors controlling movement through a curved portion of a wall must be carefully controlled in order to further enhance the effect of the wall in separating different areas of a particular ride attraction. For example, as the guest enters into an area defined at least partially by the wall, the wall may be intended to optically isolate the guest from other sections of the amusement ride on another side of the wall (e.g., block the guest from being able to see at least some other sections of the amusement ride and block light from another side of the wall). That is, it may be desirable for the wall to be as continuous (e.g., closed) as possible to the outside environment in order to avoid any sight lines through the wall, or to avoid any light from entering into a partial or total enclosure formed using the wall while the guest is situated within.

It should be borne in mind that a wall that curves to form a partial enclosure, or even a straight wall in some embodiments, creates optical isolation of, for example, a forward section of a path (or a direction in which the ride vehicle enables passengers to view the path), but not necessarily a rearward section of a path (or a direction in which the ride vehicle does not enable passengers to view the path), and so on. In this regard, the disclosure of a "wall," as used herein, may encompass a partial or full dome, or at least one straight or curved wall of multiple walls connected together (e.g., three walls connected together), and the like.

For portals through relatively straight (planar) walls, even if slanted, different sections of a ride attraction may be sufficiently isolated from one another using a traditional door mechanism (e.g., a door that is connected to the remaining portion of a wall via one or more hinges), though the present approaches enable enhanced isolation even in these arrangements. In curved structures, however, such as those used in an aspect of the present disclosure, closure via such a hinge mechanism may not be sufficient or appropriate. Indeed, in embodiments where both the door and the wall are curved, or have edge geometries that are irregular (e.g., not straight), such hinge-based closure mechanisms may not be reliable, and may place mechanical stress on various portions of the door and the wall. Furthermore, in embodiments where the door forms a part of the wall (e.g., a total enclosure or partial enclosure) and the door and wall are used to display a continuous image (e.g., a "show enclosure," a "show partial enclosure," or a "show wall" having a "show door"), very tight tolerances between the door and the wall may be desired to mitigate discontinuity in the image. In this way, a show door, as described herein, may be used interchangeably with the term "screen," which is intended to denote that the show door is or otherwise includes a display screen for displaying images to guests. Accordingly, it should be borne in mind that the disclosure of a "show door" is also intended to denote the presence of a "screen."

In accordance with the present disclosure, it is now recognized that removal and replacement of the door from and to the wall (e.g., to complete the wall) may be performed using one or more complex trajectories of the door through three-dimensional space. For example, in an embodiment, the door is removed and replaced in a trajectory (which may be the same or different for removal and replacement) that causes the door to be withdrawn and approach the opening of the wall in a relatively straight line, though the trajectory may also include other directional movements. The complex trajectory of the door, which includes at least one translation of the door and at least one rotation of the door, may be generated using an actuation system. In an aspect of the present disclosure, the actuation system includes a robotic actuation system having a robotic actuator with at least three, such as four, five, six, seven, or more, mechanical degrees of freedom.

In certain embodiments, the robotic actuator may include a plurality of rigid bodies connected to one another by movable couplings, which may include rotatable bearings, hinges, and the like. By way of example, the robotic actuator may include between 2 and 6 rigid bodies in order to provide the degrees of freedom noted above. As a specific example, the robotic actuator may include a robotic arm having two or more elbow-like hinge mechanisms (e.g., mechanical hinge joints), and two or more wrist-like fully rotatable mechanisms (e.g., mechanical swivel joints). By moving the door using such an actuation system, the door may be removed and replaced in a highly reproducible manner and with excellent precision compared to configurations where movement is constrained only by one or more hinge mechanisms coupling the door and the wall. Further, moving the door along a compound trajectory using the actuation system may also enable additional visual effects to be provided to guests by the show door, even while the show door is moving.

It should be noted that the present disclosure is intended to apply to many different settings in which a show wall (e.g., straight wall, or a total or partial enclosure) includes a show door, and both are used to provide an immersive simulation to guests. It should be noted that the use of the term "show door" is intended to denote a door that functions to enable transition between two sections of an amusement attraction separated by a wall (e.g., a curved wall forming a partial or full dome), and also simultaneously functions to display images (e.g., static or changing) to guests as they move past the door.

To demonstrate the various functionalities of the present approaches, the present technique is described with respect to a ride attraction system that includes one or more ride vehicles that transport guests through an area of an amusement park. FIG. 1, which is a schematic diagram, depicts an embodiment of such an amusement park ride attraction 10. As depicted, the attraction 10 includes a track 12 that forms a path 14 through the attraction 10. For simplicity, the track 12 is shown as having different divided sections spanning from an entrance to an exit of the attraction 10, but may also include other sections that are similar to or different from the features explicitly illustrated in FIG. 1. Further, it should be noted that certain features such as cabling, supports, etc., have been omitted for clarity. However, such features are intended to be included in the illustrated attraction 10. In addition, the embodiment illustrated in FIG. 1 is intended to encompass configurations in which there is no track, but nevertheless includes a defined path along which a ride vehicle 16 may travel, for instance in one or more directions of travel. The path may be defined by environmental features, pre-programmed actuations using electronic controls, sensors, and so forth, or any other appropriate mechanisms.

One or more ride vehicles 16 may be coupled to the track 12 (e.g., placed onto or suspended on the track 12), thereby following the path 14 through the attraction 10. The ride vehicles 16 may include seating or another securing mechanism for guests, as well as other features for enhancing the riders' experience (e.g., visual, audible, and/or tactile effects). As one example, speakers may be provided so as to provide audible cues to direct the guests' attention to different areas of the attraction 10. The ride vehicles 16 may also include electromechanical and/or electromagnetic actuation systems configured to move the ride vehicles 16 along the track 12 (e.g., in forward and backward directions 18, 20). In some instances, such actuation systems may be configured to generate additional movement to provide additional physical effects (e.g., to provide a roll, pitch, or yaw movement to the ride vehicle 16).

The ride vehicle 16 of FIG. 1 is depicted as being in communication with a control system 22, which may include an automation controller (e.g., a programmable logic controller). The communication may be wired and/or wireless, and enables the control system 22 to send control signals to the ride vehicle 16 to cause the vehicle 16 to stop, move, etc. Indeed, any one or a combination of the equipment contained within the ride vehicle 16 may be partially or completely controlled by the control system 22.

The movement of the ride vehicle 16 may, additionally or alternatively, be controlled using other mechanisms. For example, in some embodiments, the control system 22 may be communicatively coupled to the track 12 to enable the control system 22 to send control signals to various systems of the track 12 that in turn cause the ride vehicle 16 to move (or stop). For instance, the control system 22 may send control signals to the ride vehicle 16 and/or the track 12 that cause various electromechanical and/or electromagnetic actuators to be energized and thereby move or stop the ride vehicle 16, or provide additional visual, audible, or tactile effects. In some embodiments, the ride vehicle 16 may also be moved on the track 12 to a motion base, where the ride vehicle 16 pauses. While on this motion base, the control system 22 may cause additional systems, such as actuation systems of the motion base, to move the ride vehicle in various pitch, roll, and yaw-like movements to simulate travel along a path. In some embodiments, this may be done in combination with a wall and/or enclosure that is configured to display a simulated path to the ride vehicle 16 in concert with the movement of the motion base.

Indeed, the control system 22 may coordinate movement of the ride vehicle 16 with other systems that are part of the ride attraction 10. Processing circuitry including, for example, a memory 24 (e.g., non-transitory, machine-readable media including one or more memory devices working in concert) and a processor 26 (e.g., one or more processors working in concert) enable the control system 22 to perform such coordination. The memory 24 may include stored instructions executable by the processor 26 to coordinate the operation of, for example, the track 12, the ride vehicle 16, and various features used to entertain guests riding in the ride vehicle 16. In this way, the control system 22 may be configured to perform these tasks by way of the instructions stored on the memory 24 and the processor 26 appropriately configured to execute these instructions. Thus, when referring to acts performed by the control system 22, it should be appreciated that such acts are intended to denote that the processing circuitry is executing the appropriate instructions.

Any device or combination of devices may be used to implement the control actions described herein, provided that the devices include appropriately programmed circuitry and associated equipment for their implementation. As a specific example, the control system 22 may include one or more programmable logic controllers (PLC) and any appropriate networking equipment. In this way, the PLC may control the different elements of the attraction 10 in a manner that is similar to a control system utilized for production lines (e.g., assembly lines), where a certain set of actions are performed by a system to achieve a reproducible result. Indeed, it is presently recognized that such controllers may be desirable for controlling, among other features of the attraction 10, a robotic actuation system 28 used to repeatedly remove and replace a show door 30 forming part of a show wall 32. It should be noted that the show wall 32 is illustrated as a block with associated openings to demonstrate that the wall may be curved, and may therefore form a partial or full enclosure into which the ride vehicle 16 enters. However, the present disclosure is intended to encompass embodiments where the show wall 32 is straight.

The control system 22 may, as an example, cause the ride vehicle 16 to move in the forward direction 18 along the track 12 and toward the show wall 32 (e.g., toward a partial or full enclosure). The control system 22 may coordinate this movement with the movement of the show door 30 using the robotic actuation system 28. For example, as the ride vehicle 16 approaches the show wall 32 (e.g., to enter into a section at least partially defined using the wall 32), the control system 22 may maintain the show door 30 in a resting position in which the show door 30 occupies the path 14 of the ride vehicle 16 (e.g., a forward section of the path 14). This may be referred to as a first portion of the movement of the ride vehicle 16 along the path 14, in which the show door 30 does not move and may be used to display images in the general direction of the ride vehicle 16. This resting position, in certain embodiments, may be on a motion base as described above.

During a second portion of the movement of the ride vehicle 16 along the path 14, the control system 22 may send control signals to the robotic actuation system 28 to move the show door 30 out of the path 14, thereby enabling the ride vehicle 16 to pass out of a portal 34 or opening of the show wall 32. As described in further detail below, the movement of the show door 30 by the robotic actuation system 28 may be such that the show door 30 follows a compound trajectory including at least one translation 36 (e.g., toward and/or away from the wall 32) and at least one rotation 38 (e.g., a tilt of the show door 30 about a midline axis).

To enable additional or exaggerated motion of the show door 30, the robotic actuation system 28 may also be displaced generally in the forward and backward directions 18, 20 of the ride vehicle 16. For instance, the robotic actuation system 28 may move the show door 30 in the forward direction 18 by translation of the robotic actuation system 28 along the path 14. This movement may be in synchrony with the movement of the ride vehicle 16 in the forward direction 18, though only for a portion of the length of the track 12 (e.g., between 1 and 5 lengths of the ride vehicle 16). Displacing the show door 30 in this manner may also enable the show door 30 to continue displaying an image toward the ride vehicle 16 even after the ride vehicle 16 has completely exited an enclosure or passed through the wall 32.

The translational movement of the robotic actuation system 28 along the path 14 may be accomplished using any mechanism capable of displacing at least a robotic arm of the actuation system 28 along the path 14. For example, a robotic arm of the robotic actuation system 28 may be coupled to a track or slide mechanism that translates the arm in synchrony with a portion of the movement of the ride vehicle 16 along the path 14. Generally, the movement of the robotic actuation system 28 would be controlled using the control system 22, though other control features may be provided.

It should be noted that the present disclosure is not limited to the use of a single robotic actuation system 28 (or actuator), or a single show door. For example, in some embodiments, another door may move to form an entrance 40 (or a different exit for a different direction) into or out of an enclosure partially defined by the show wall 32. Indeed, the show wall 32 may include multiple doors for moving through the section of the attraction 10 corresponding to the show wall 32. If the entrance 40 is formed by moving a door, the door may or may not be a show door operated in substantially the same manner as the show door 30 (e.g., by the robotic actuation system 28 or another actuation system). In such a configuration, the additional door that forms the entrance 40 may also correspond to an exit from another section of the ride attraction 10, and may be used to display a different theme or different sets of images compared to the show door 30 and the show wall 32. In still further embodiments, such as when the show wall 30 curves but does not fully enclose a section of the path 14, the entrance 40 may be a permanent opening.

In certain configurations, depending on the theme of the ride attraction, for example, the first portion of the movement of the ride vehicle 16 (e.g., toward the show wall 32 and show door 30) and the second portion of the movement of the ride vehicle 16 (e.g., through the show wall 32) may be separated by a delay. As an example, the ride vehicle 16 may pause within a full or partial enclosure formed using the show wall 32. During this pause, images may be displayed toward the ride vehicle 16 from a display surface 42 of the show wall 32. Indeed, even in situations where the ride vehicle 16 does not pause within or in front of the show wall 32, the show wall 32 may display such images on the display surface 42. The display surface 42 may be only a portion of an inner surface of the show wall 32 (e.g., the surface on the concave side of a curved wall), or may be the entire inner surface of the show wall 32. Further, as noted above, the show door 30 may form a part of the wall 32 when the show door 30 is in its resting position, thereby forming a part of the display surface 42 such that the display surface 42 is substantially continuous across a mating between the wall 32 and the show door 30.

The display surface 42 may use any technology for providing images, and may include, as non-limiting examples, a projection surface onto which a projector projects images, a liquid crystal display (LCD), a light emitting diode display (LED display), organic light emitting diode display (OLED), an electroluminescent display, a plasma display panel, an electronic ink display, or any combination of these and/or other display technologies. In one aspect of the present disclosure, the display surface 42 may include a projection screen onto which projected images 44 are incident on a projection surface 46, which may be the same side as, or an opposite side of, the display surface 42.

A projection system 48 including one or more projectors 50, at least partially under the control of the control system 22, may generate the projected images 44. The projection system 48 may store data corresponding to the projected images 44, for example on a non-transitory, machine-readable medium, or may simply access or receive the data from the control system 22 or a separate media storage unit. As an example operation, the control system 22 may execute instructions that cause the ride vehicle 16 to enter and pause within a partial enclosure formed by the show wall 32, and cause the projection system 48 to generate the projected images 44 to thereby display images to the ride vehicle 16 via the display surface 42. After a time (or no pause), the control system 22 may execute instructions that cause the ride vehicle 16 to proceed toward the portal 34 of the show wall 32 and cause the robotic actuation system 28 to move the show door 30 along the compound trajectory and out of the path 14.

To continue entertaining the guests within the ride vehicle 16, the control system 22 may also, in some embodiments, execute instructions that cause the projection system 48 to project images onto the show door 30 even as the show door 30 is moving and is at a different orientation relative to the ride vehicle 16 (e.g., compared to when the show door 30 is in its resting position). For instance, the control system 22 may execute instructions that condition the data representative of the images so that when the projected images 44 are incident onto the show door 30 at an oblique angle, they are displayed in a substantially undistorted manner. For instance, if the show door 30 is above or below the ride vehicle 16 and the display surface of the show door 30 is facing the ride vehicle 16, the projected images 44 may have an applied correction factor that corrects for the stretching of the image that would otherwise be caused by the large angle of incidence between the projected images 44 and the show door 30. Continuing the display of the images in this manner may enhance the entertaining qualities of the attraction 10, thereby creating a more pleasurable experience for the guests on the ride vehicle 16.

Figure 2:
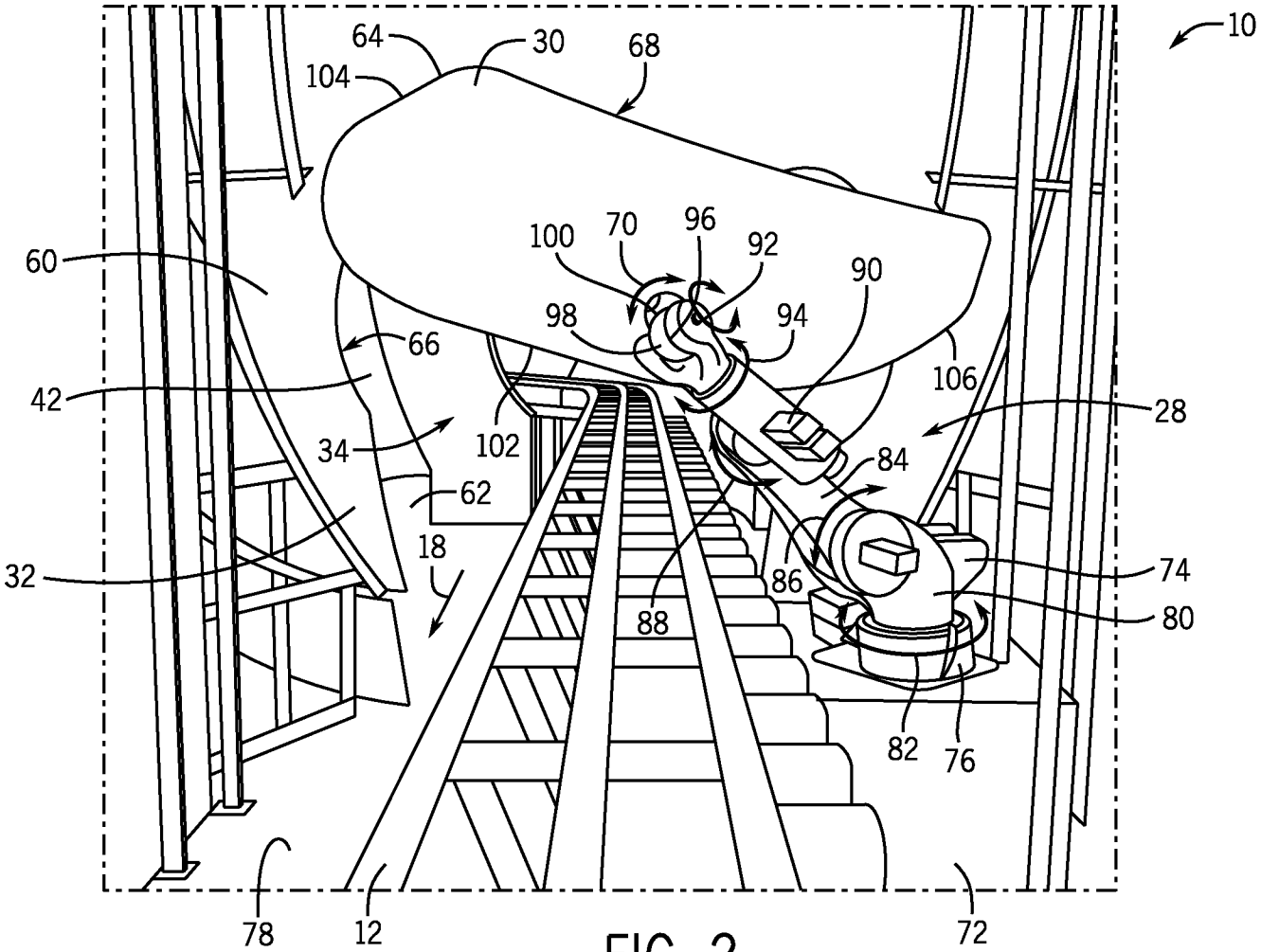
FIG. 2 illustrates a perspective view of an embodiment of the ride attraction system of FIG. 1 from a perspective behind a display screen, in which a robotic mechanism of the robotic actuation system has moved the show door out of the path of the ride vehicle, in accordance with an aspect of the present disclosure.

A schematic depiction of a more specific embodiment of the ride attraction 10 is provided in FIG. 2. Specifically, the illustrated ride attraction 10 includes a curved structure corresponding to an embodiment of the show wall 32. The show wall 32, more specifically, is a partial enclosure including a dome-like structure that may, in certain embodiments, include areas having different degrees of curvature, such as a top section 60 and a bottom section 62. In the illustrated embodiment, the top section 60 may be considered to be the curved portion of the wall 32, while the bottom section 62 may serve as a base for the wall 32, and may also contain various equipment such as portions of the projection system 48, cabling, vents, and so forth.

The show wall 32, as illustrated, mitigates the presence of sight lines on an opposite side of the wall 32 in the forward direction 18, at least in regions above the bottom section 62.

In other words, the substantial optical isolation of FIG. 2 is intended to denote the presence of a continuous projection surface (e.g., formed when the show door 30 is in place with the wall 32) that blocks the riders' view along the direction 18. In certain embodiments, there may also be no substantial illumination of an interior portion of the wall 32 from external sources other than the projection system 48.

To enable the continuous projection surface, as noted above, the show door 30 may be designed to have a mating geometry with the show wall 32 so that in its resting position there is little to no space between edges of the door 30 and wall 32. In this way, like the show wall 32, the show door 30 is also curved. Specifically, in the illustrated embodiment, the show door 30 includes curved edges 64 as well as a concave curvature (as determined with respect to the forward direction 18). A tolerance between the curved edges 64 of the show door 30 and corresponding curved edges 66 of the wall 32 (e.g., the distance between these edges when the show door 30 is mated to the show wall 32) may be no more than 1 centimeter, such as between 0.1 and 0.5 centimeters. As discussed above, such a tolerance may not be attainable using a single hinged closure mechanism where the door is directly hinged to the wall, or is at least not reproducible as may be required to produce a continuous display surface. Furthermore, the mating between the show door 30 and the show wall 32 may be produced by making their edges 64, 66 taper so as to form an interference fit. Such an embodiment is described in further detail below with respect to FIG. 5.

A display surface 68 of the show door 30 is depicted as facing generally in the rearward direction 20 as the show door 30 is withdrawn by the robotic actuation system 28 to form the opening 34. However, as discussed in detail below, in certain embodiments the robotic actuation system 28 may manipulate the show door 30 such that the display surface 68 faces toward the ride vehicle 16 until the ride vehicle 16 has completely passed the show door 30. In some embodiments, the robotic actuation system 28 may manipulate the show door 30 such that the display surface 68 faces or is angled toward a forward portion of the ride vehicle 16. When the forward portion of the ride vehicle 16 has passed the show door 30, the display surface 68 may then be turned away by the robotic actuation system 28 (e.g., to replace the show door 30 in a mated relationship with the wall 32).

As noted above, the robotic actuation system 28 may include a plurality of interconnected rigid bodies that together form an arm-like structure to manipulate the show door 30. Generally, the robotic actuation system 28 may enable multiple degrees of freedom using a single point of attachment 70 to the show door 30 (though more points of attachment may be present). In the illustrated embodiment, the robotic actuation system 28 includes six different rotational axes which together enable the show door 30 to be moved about a compound trajectory away from and toward the wall 32. It is now recognized that at least four degrees of freedom, such as between four degrees of freedom and six degrees of freedom, may enable highly reproducible and precise movement of the show door 30 in the manner described herein. In one embodiment, such as in the illustrated embodiment, six degrees of rotational freedom may enable the enhanced show door effects described herein.

The robotic actuation system 28 may include a base portion 72 to which a robotic mechanism 74 (e.g., a robotic actuator/arm) is attached. The base portion 72 may house various equipment, such as computing equipment (e.g., processors and memory), power supplies, fuses, servomechanisms, cabling, thermal management equipment, signal converters, connection panels for connecting to external devices, and so forth. The computing equipment may be configured to cause independent actuation of a single one of a plurality of rigid bodies of the robotic mechanism 74, thereby causing movement of the show door 30 about or along various axes. The illustrated robotic mechanism 74 includes a first rigid body 76 fixedly secured to the base portion 72, which is in turn secured to a platform or floor 78 of the ride attraction 10. In this way, even though portions of the robotic mechanism 74 are able to rotate, the first rigid body 76 may be unable to move along the floor 78. However, as noted above, the robotic actuation system 28 (e.g., the base portion 72) may include a track or slide mechanism, or another mechanism, that enables translation of the robotic mechanism 74 along the floor 78, for example in the forward and backward directions 18, 20. For instance, the translation may be limited to between one and five lengths of the ride vehicle 16 along the track 12.

The various movable parts of the robotic mechanism 74 may be actuated using any appropriate type of energy transfer mechanism, such as electromechanical, pneumatic, hydraulic, electromagnetic, or the like. Thus, in certain embodiments, the base portion 72 may include appropriate equipment for enabling such actuation, such as power converters, compressors, magnets, etc. In the illustrated embodiment, actuation of the different rigid bodies of the robotic mechanism 74 is driven only electromechanically.

Referring now to the various portions of the robotic mechanism 28, the first rigid body 76 is coupled to a second rigid body 80 via a first rotational coupling 82, which may be considered a first wrist-like coupling, or wrist axis. The first rotational coupling 82 generally enables a full 360 degrees of rotation about the vertical axis defined from the floor 78 and through the center of the first rigid body 76 (e.g., perpendicular with respect to the forward direction 18). However, the control system 22 (FIG. 1) may provide additional feedback that constrains the rotation of the second rigid body 80, for example to avoid collision with the wall 32, or to prevent unnecessary movement that would increase the time between removal of the show door 30 and its replacement. In other embodiments, such constraint may be performed by the various computing equipment of the robotic actuation system 28 (e.g., the computing equipment in the base portion 72). Generally, the first rotational coupling 82 may be considered to move the entire movable portion of the robotic mechanism 74, and the show door 30, toward and away from the wall 32. Indeed, the first rotational coupling 82 may be a significant contributor to the linear portion of the compound trajectory of the show door 30, i.e., the translation of the show door 30 through three-dimensional space.

To enable a second rotational degree of freedom, the second rigid body 80 is coupled to a third rigid body 84 via a first hinge coupling 86. The first hinge coupling 86 may enable rotation about an axis oriented crosswise to, but offset from, the vertical axis noted above. Generally, the rotation of the third rigid body 84 about the first hinge coupling 86 controls the height of the remainder of the robotic mechanism 74 coupled to the show door 30, and rotates the show door 30 along planes oriented generally parallel to the vertical axis of the first rigid body 76. Indeed, rotation about the first hinged coupling 86 may raise and lower the show door 30. In the illustrated embodiment, the third rigid body 84 may be maintained at an angle greater than 90 degrees relative to the vertical axis of the first rigid body 76 maintain the show door 30 above the track 12. In other embodiments, such as when the ride vehicle is suspended from the track 12, the third rigid body 84 may be maintained below a certain angle, such as an oblique angle below 90 degrees relative to the vertical axis of the first rigid body 76.

A second hinged coupling 88 is formed between the third rigid body 84 and a fourth rigid body 90. The second hinged coupling 88 enables rotation within the same plane as the first hinged coupling 86. However, the shorter distance between the second hinged coupling 88 and the point of attachment 70 to the show door 30 enables a greater degree of precision of the tilt of the show door 30. That is, the first hinged coupling 86 may move the show door 30 in a larger circular displacement compared to the second hinged coupling 88. In addition, the first hinged coupling 86 and the second hinged coupling 88 may generally enable the robotic mechanism 74 to clear the show door 30 out of the path 14 of the ride vehicle 16.

As may be appreciated, the further away from the base portion 72, the finer the control the robotic mechanism 74 can provide. Thus, the remaining couplings may be used for fine control and positioning of the show door 30 relative to the ride vehicle 16 and to the wall 32. In the illustrated embodiment, the fourth rigid body 90 is coupled to a fifth rigid body 92 via a second rotational coupling 94, which enables a fourth rotational degree of freedom. A third hinged coupling 96 connects the fifth rigid body 92 and a sixth rigid body 98 to enable a fifth rotational degree of freedom, and a third rotational coupling 100 connects the sixth rigid body 98 to the point of attachment 70 of the show door 30 (e.g., via a seventh rigid body).

As an example, a compound trajectory that moves the show door 30 from its resting position (e.g., mated with the wall 32) to the illustrated position may include a first rotation about the first rotational coupling 82 that moves the entire movable portion of the robotic mechanism 74 from the second rigid body 80 to the show door 30 in an arc, which may generally move the show door 30 in a curved direction along direction 18. However, additional rotations by the robotic mechanism 74 make this movement substantially linear for the show door 30.

A second rotation about the first hinged coupling 86 moves the show door 30 and the third through sixth rigid bodies generally away from the track 12 and path 14. A third rotation about the second hinged coupling 88 exaggerates this movement. A fourth rotation about the second rotational coupling 94 may cause a bottom portion 102 of the show door 30 to tilt away from the track 12, while a fifth rotation about the third hinged coupling 96 causes a left edge 104 and a right edge 106 of the show door 30 to tilt relative to one another (e.g., to raise the left edge 104 relative to the right edge 106 about its longitudinal midline). This fifth rotation about the third hinged coupling 96 also causes a portion of the rotational movement caused by the rotation about the first rotational coupling 82 to become substantially linear from the perspective of the show door 30. A sixth rotation about the third rotational coupling 100 causes the left edge 104 and the right edge 106 of the show door 30 to tilt relative to one another about its center, again raising the left edge 104 relative to the right edge 106.

Similar movements may be performed to replace the show door 30. However, the trajectory used to remove the show door 30 from the wall 32 need not be retraced (e.g., reversed) to replace the show door 30 onto the wall 32. Indeed, in replacing the show door 30, the show door 30 may be moved by the robotic actuation system 28 along a second compound trajectory that is the same (i.e., the same path) or different (i.e., a different path) compared to the first compound trajectory.

While the show door 30 is depicted in the illustrated embodiment as having its display surface 68 pointed away from the track 12 and, therefore, the ride vehicle 16, it should be noted that the control system 22 may, in certain embodiments, cause the robotic actuation system 28 to cause the display surface 68 to continue pointing toward the ride vehicle 16 even as the show door 30 is removed from the wall 32. Indeed, in certain embodiments, the show door 30 may, even when above the ride vehicle 16, continue to display an image to the ride vehicle 16.

In this regard, the robotic mechanism 74 may enable continued image display to the ride vehicle 16 via the show door 30 by maintaining an appropriate positional and orientational relationship of the show door 30 relative to the projectors 50 of the projection system 48 and the ride vehicle 16. In addition, as noted above, the media that is reproduced as an image by the projection system 48 may be pre-conditioned using image processing functions resulting in stretching and/or squinching of areas of the projected images 44. When projected onto the display surface 68 of the show door 30 the image may be substantially undistorted. That is, data that is used to produce the images on the show door 30 and/or show wall 32 may be pre-conditioned via one or more algorithms (e.g., computer-based processes) that result in compression (squinching) and/or expansion (stretching), or any other distortion and/or perspective correction of different regions of the image. The various image processing algorithms may serve many purposes, for example to correct for distortion, perspective, and so forth. Further, as described in further detail below, such processes may enable at least some masking of transitions between opening and closing of the show wall 32 using the show door 30.

FIG. 3 is an example representation of the manner in which the show door 30 may be used to display images to guests within the ride vehicle 16 after the show door 30 is un-mated from the show wall 32. Specifically, FIG. 3 can be considered to represent a perspective of a rider within the ride vehicle 16 as the vehicle exits the show wall 16. As depicted, the show door 30 is removed from the wall 32 to expose its edges 64, as well as the edges 66 of the show wall 32. While the show door may be moved out of the ride vehicle's clearance envelope (e.g., the space occupied by the ride vehicle so that the ride vehicle is not touched) via any compound trajectory, in the illustrated embodiment the show door 30 is considered to be partially overhead in the schematic, and is continuing to display image elements 100 (e.g., clouds) on its display surface 68. The wall 32 is also displaying the image elements 100 on its display surface 42.

As discussed above with respect to FIG. 1, the projection system 48, which may include projectors 50 that generate the projected images 44 for display on the display surfaces 42, 68, may also perform certain processing on the data corresponding to the displayed images. Alternatively or additionally, the control system 22 may perform such processing. As an example, the data may be preconditioned so as to display in a substantially undistorted manner on the display surfaces 42, 68, which are both curved. The data may also be preconditioned to enable edge blending, for example between projected images 44 generated by different projectors 50 and/or to correct for surfaces of different depth.

For example, a first image element 112 spanning a boundary 114 between the edge 66 of the wall 32 and the display surface 68 may be pre-processed so that the boundary 114 (or transition) between these two structural features is not readily apparent. The pre-processing of certain image elements may be based on, for example, a motion path of the show door 30 as a function of time. In this way, as the show door 30 moves along the motion path, the projection system 48 (and/or control system 22) conditions the data resulting in the image elements, or conditions the projected image elements, such that, for example, their intensity of projection increases to account for increased distance between the projectors 50 and the door 30, and the data and/or image elements may be conditioned to account for angling, movement, and so on.

One result of this conditioning of the image elements and/or data used to produce the elements is that the edge 66 may not be apparent, and is masked by the image element 112. Such pre-conditioning of the data may include correction for difference in image luminescence (e.g., illumination of two different surfaces at different distances by projection at different intensities), correction for different angles of incidence of the different display surfaces 42, 68, correction for color shifting depending on the movement of the ride vehicle 16 and/or door 30, and so on. Further, as noted above, the individual image elements 100 may be conditioned to different extents depending on which display surface 42, 68 they illuminate, which may also account for distance, orientation, etc. In this regard, the media may be preconditioned so as to mask the transition from a closed state to an open state of the show wall 32, thereby enhancing the effect of being transported between different settings. After the ride vehicle 16 exits or passes through the wall 32, the remaining portion of the show door 30 may be visible, which in the illustrated embodiment corresponds to an overlapping portion 116 bounded by the edge 66 of the wall 32 and the dashed edge of the show door 30.

The particular orientation of the show door 30 relative to the observer (e.g., relative to the ride vehicle 16) may be generated, as noted above, using the at least one translation 36 and the at least one rotation 38 generated by the articulating elements of the robotic actuation system 28 (e.g., the robotic mechanism 74). Together, these movements produce a compound trajectory 118, an example of which is illustrated to the side of the show door 30 (the translation 36 is shown as a point to represent that the direction is into the page). It should be noted that while the compound trajectory 118 includes the translation 36 and the rotation 38, the rotation 38 actually includes component rotations that are different. Specifically, the rotation 38 is not limited to only being about an axis defined by the translational direction, but is a compound rotation diverging away from the translational direction formed by additional rotation (e.g., tilting) of the show door 30. Accordingly, the rotation 38 in the illustrated embodiment is a compound rotation about multiple axes.

Again, the control system 22 may coordinate the operation of any one or a combination of the elements described herein, either alone or in combination with the various processing devices/computing equipment associated with the ride vehicle 16, the track 12, the robotic actuation system 28, the projection system 48, and so forth. An example of a method 130 of operating the attraction system 10 is depicted as a block flow diagram in FIG. 4.

As illustrated, the embodiment of the method 130 includes moving (block 132) a ride vehicle (e.g., ride vehicle 16 of FIG. 1) along a path (e.g., path 14) toward a wall, such as a wall forming a partial enclosure or a wall of a total enclosure. In accordance with an embodiment, the wall is curved. As discussed above, the path may be defined by tracks on which the ride vehicle is positioned, but other configurations may utilize other features to constrain movement by a ride vehicle. For example, a ride vehicle may include pre-stored commands for movement along a path defined by, for instance, environmental features. Such a ride vehicle may include electric motors, or other types of motors for moving the occupant and vehicle along the path. In a ride attraction such as described above, the control system 22 may cause the ride vehicle 16 to move along the track 12 in implementing all or a part of the acts represented by block 132.

The method 130 may also include occupying (block 134) the path of the ride vehicle with a show door (e.g., show door 30). The acts represented by block 134 may include, as an example, positioning a show door in a mated relationship with the wall so as to complete (block 136) the wall with the show door. The show door and wall may, as an example, produce a continuous display surface for displaying images (block 138) to occupants on the ride vehicle. In other embodiments, the respective display surfaces of the show door and the wall may be used to display separate, non-continuous images.

It should be noted that the images displayed by the wall may be static, i.e., unchanging, or may change over time. In this regard, the images displayed by the show door may also be unchanging, or may change over time, either separately from or in concert with the images displayed by the wall.

At a predetermined point in time of the ride, the method 130 may include moving (block 140) the show door out of the path of the ride vehicle, for example using a compound trajectory in the manner described above (e.g., including at least one rotation and at least one translation). During this movement, the ride vehicle may also move toward the show door to move through the wall.

Also during this movement of the show door along the compound trajectory, the method 130 may, in certain embodiments, include continuing (block 142) to display images to the ride vehicle using the show door. As described above, such displaying may include coordination of image projection by the projection system (e.g., projection system 48 of FIG. 1), movement of the show door along the compound trajectory by a robotic actuator (e.g., of actuation system 28 of FIG. 1), and image pre-conditioning/correction to account for the positional and orientational relationship of the show door relative to the ride vehicle as a function of time, the position of the ride vehicle along the path, or both.

The mating between the show door 30 and the show wall 32, and the movement of the show door 30 relative to the show wall may be further appreciated with respect to FIG. 5. Specifically, FIG. 5 is a scheme 150 depicting a view through a cross-section of the show wall 32 and door 30 as the door 30 transitions between a mated relationship with the wall 32 (at the bottom of the figure) and to a position where images are displayed by the door 30 in a generally crosswise direction relative to the wall 32 (at the top of the figure).

In certain embodiments, as discussed above and as represented in FIG. 5, the show door 30 and wall 32 may be curved. To enable enhanced mating between these curved surfaces, the edges 64 of the door 30 and the edges 66 of the wall 32 may be tapered. This tapering may result in a mated relationship 152 between the edges 64, 66 that prevents light from entering through the joint between the door 30 and the wall 32. In essence, in the illustrated embodiment, the mating can be considered to be an interference fit between the door 30 and the wall 32. It should therefore be appreciated that for such a fit to occur, the door 30 may be moved along a relatively straight motion path for at least a short distance. Again, such movement is enabled, and is highly reproducible, using the robotic actuation system 28 (FIGS. 1-3).

The taper in the edges is generally formed by having a smaller perimeter for the innermost surface for the wall 32 and door 30. Generally, this means that their respective display surfaces 42, 68, will have a smaller perimeter compared to a perimeter of their respective outer surfaces 154, 156. The respective outer surfaces 154, 156 may generally be defined to be the surface opposite the display surface, or the surface that is facing away from a direction of travel of the ride vehicle.

Beginning at the bottom of FIG. 5, the wall 32 and door 30 are shown in the mated relationship. As discussed above with respect to FIGS. 1 and 4, when in this relationship, the projection system 48 may project the projected images 44 onto the respective display surfaces 42, 68 (or an opposite surface, depending on configuration). The projected images 44 may be pixel-mapped so that they are presented on the display surfaces 42, 68 in a relatively undistorted manner.

As the door 30 is moved along the compound trajectory 118, the door 30 moves along the at least one translation 36, which pulls the door 30 from the interference fit coupling to the wall 32. Again, such a fit may be desirable to form a continuous display (e.g., projection) surface and substantially optically isolate one section of the ride attraction from another. The projected images 44 may still be projected onto the display surface 42 of the show wall 32. However, in embodiments where the show door 30 continues to display images, images projected onto the show door 30 may be projected images with depth correction 158. Again, this depth correction may account for a difference in projection distance between the projectors 50 (FIG. 1) and the wall 32 and the projectors 50 and the door 30 by intensity correction, pixel resolution correction, and so forth. In this way, the difference in depth may not be apparent. As discussed with respect to FIG. 3, a certain amount of edge blending may be done so as to mask the edge transition between the door 30 and the wall 32.

As the door 30 continues along its compound trajectory 118, as noted above, the door 30 may continue to display images. In the illustrated embodiment, for example, the door 30 has transitioned to a position that is below the ride vehicle 16 (i.e., between the ride vehicle and the floor), and its display surface 68 is angled upward and toward the ride vehicle 16, as opposed to being situated above (i.e., the ride vehicle is at least partially between the door 30 and the floor) and angled downward toward the ride vehicle as shown in FIG. 3. Image elements displayed on the display surface 68 may therefore correspond to features that could be situated below an observer, such as water.

The images projected onto the door 30 in the uppermost configuration may be projected images with both depth and orientation correction 160. Such depth and orientation correction may include a similar depth correction as noted above, and the orientation correction may include correction factors applied that account for differences in angle of incidence, further differences in luminance, and so forth.

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A ride attraction system comprising:

a ride vehicle configured to transport passengers along a path;

a screen having a resting position in which the screen occupies the path, wherein the screen comprises a display surface configured to display an image to the ride vehicle along a portion of the path;

an actuation system physically coupled to the screen and configured to move the screen from its resting position and along a compound trajectory comprising at least one translation and at least one rotation; and a control system in communication with the actuation system and comprising one or more processing devices configured to cause the actuation system to move the screen from its resting position along the compound trajectory and out of a clearance envelope of the ride vehicle as the ride vehicle approaches the screen and passes the resting position vacated by the screen, wherein the actuation system comprises a robotic arm having at least two controllable degrees of freedom, and the robotic arm is attached to the screen on a side of the screen opposite the display surface, and wherein the robotic arm comprises a base that is coupled to a floor at a position adjacent to the path of the ride vehicle, the base being coupled to the floor in a manner that resists movement of the base relative to the path.

2. The system of claim 1, comprising a projection system having one or more projection devices and configured to project the image onto the display surface.

3. The system of claim 2, wherein the compound trajectory is such that the display surface of the screen remains facing toward the ride vehicle until the vehicle is past the screen, and the projection system is configured to continue projecting the image onto the screen through at least portions of the compound trajectory such that the image can be observed from within the ride vehicle on the display surface.

4. The system of claim 3, wherein the projection system or the control system is configured to apply a distortion or perspective correction function to data corresponding to the projected image to enable the image to be reproduced in a substantially undistorted manner on the screen along at least portions of the compound trajectory.

5. The system of claim 2, wherein the screen comprises a curved geometry.

6. The system of claim 5, comprising a curved wall configured to at least partially surround a section of the path, the curved wall enabling substantial optical isolation of the section of the path resulting in no view or only a limited view of the path past the curved wall, wherein the screen forms a region of the curved wall in its resting position and comprises a mating geometry configured to mate with the remaining regions of the curved wall and thereby enable the substantial optical isolation of the section of the path when in the resting position.

7. The system of claim 6, wherein the curved wall comprises an additional display surface onto which the projection system is configured to project one or more images.

8. The system of claim 7, wherein the one or more images projected onto the additional display surface change over time.

9. The system of claim 7, wherein the image projected onto the display surface of the screen is pre-processed to account for movement of the screen based on a motion path determined by at least a portion of the compound trajectory, and the pre-processing enables blending between respective edges of the screen and the wall so as to mask movement of the screen away from the wall.

10. The system of claim 7, wherein the control system is communicatively coupled to the projection system and the ride vehicle, and the one or more processing devices are configured to execute instructions to coordinate the operation of the ride vehicle, the actuation system, and the projection system to cause the ride vehicle to progress toward the curved wall, cause one or more images to be projected onto the display surface and the additional display surface, and cause the actuation system to move the screen out of the path along the compound trajectory as the ride vehicle travels along the path and through the curved wall.

11. The system of claim 1, wherein the robotic arm comprises between three and six controllable degrees of freedom.

12. The system of claim 1, wherein the robotic arm comprises a collection of rigid members connected via movable couplings, a first rigid member of the rigid members is indirectly secured to a floor via a first movable coupling, the path is defined by first tracks secured to the floor, wherein the ride vehicle is configured to travel on the tracks to move along the path, and wherein the first rigid member is positioned proximate the first tracks.

13. The system of claim 12, wherein the first movable coupling only allows rotation of the first rigid member such that the first rigid member is unable to move along the floor.

14. A method of operating a ride attraction system, comprising:

moving a ride vehicle along a path;

displaying an image in a display direction toward the ride vehicle using a screen;

occupying a forward section of the path with the screen during a first portion of the movement of the ride vehicle along the path, wherein the screen is in a resting position during the first portion of the movement of the ride vehicle such that the ride vehicle approaches the screen;

moving the screen along a first compound trajectory using a robotic actuation system comprising a robotic arm having at least two controllable degrees of freedom coupled to the screen, the movement of the screen along the first compound trajectory occurring during or before a second portion of the movement of the ride vehicle along the path such that the ride vehicle passes the screen without touching the screen, wherein the first compound trajectory comprises at least one translation and at least one rotation, and wherein a base of the robotic arm does not move relative to the path while the screen is moved along the first compound trajectory; and moving the screen along a second compound trajectory once the ride vehicle has passed the screen, wherein the second compound trajectory moves the screen to the resting position, and wherein the base of the robotic arm does not move relative to the path while the screen is moved along the second compound trajectory.

15. The method of claim 14, comprising moving the screen along the first and second trajectories using only rotational movement of the robotic actuation system.

16. The method of claim 14, wherein displaying the image in the display direction toward the ride vehicle using the screen comprises projecting the image onto the screen during the first portion of the movement of the ride vehicle along the path using a projection system comprising one or more projection devices, and the projection system is configured to project the image onto the screen through at least a portion of the first compound trajectory.

17. The method of claim 16, comprising:

moving the ride vehicle into at least a partial enclosure that is curved, the movement occurring during the first portion of the movement of the ride vehicle, wherein the screen forms a part of the at least partial enclosure when occupying the path in its resting position;

projecting one or more images onto a surface of the at least partial enclosure using the projection system such that the one or more images seemingly create an environment at least partially surrounding the ride vehicle; and moving the screen along the first compound trajectory to create an opening in the at least partial enclosure through which the ride vehicle travels during the second portion of the movement of the ride vehicle.

18. The method of claim 17, comprising continuing to project the image onto the screen as the screen moves along the first trajectory and above the ride vehicle, the image having an applied correction when the screen is above the ride vehicle such that the image continues to be displayed by the screen in a substantially undistorted manner.

19. The method of claim 14, wherein the second compound trajectory re-traces the first compound trajectory.

20. A ride attraction system, comprising:

a path of travel;

a curved wall including an opening through which the path extends;

a ride vehicle positioned on the path and configured to move along the path into an enclosure including the curved wall;

a screen having a curved geometry corresponding to the opening in the curved wall, the screen being coupled to a robotic actuation system having a robotic actuator comprising between four and six degrees of freedom, the robotic actuation system being configured to move the screen between a first position and a second position, wherein in the first position the screen fills the opening to form a portion of the curved wall and occupies the path of travel with respect to the ride vehicle, and in the second position the screen is removed from the opening such that the screen does not occupy the path of travel with respect to the ride vehicle; and a projection system having one or more projection devices and configured to project an image onto a surface of the curved wall and a surface of the screen.

21. The system of claim 20, comprising a control system in communication with at least the robotic actuation system and the projection system, the control system comprising one or more processing devices configured to cause the robotic actuation system to move the screen along a compound trajectory between the first and second positions in synchrony with the projection of images onto the screen and the curved wall using the projection system.

22. A ride attraction system comprising:

a ride vehicle configured to transport passengers along a path;

a screen having a resting position in which the screen occupies the path, wherein the screen comprises a display surface configured to display an image to the ride vehicle along a portion of the path;

an actuation system physically coupled to the screen and configured to move the screen from its resting position and along a compound trajectory comprising at least one translation and at least one rotation, wherein the screen has a curved geometry;

a control system in communication with the actuation system and comprising one or more processing devices configured to cause the actuation system to move the screen from its resting position along the compound trajectory and out of a clearance envelope of the ride vehicle as the ride vehicle approaches the screen and passes the resting position vacated by the screen; and a curved wall configured to at least partially surround a section of the path, the curved wall enabling substantial optical isolation of the section of the path resulting in no view or only a limited view of the path past the curved wall, wherein the screen forms a region of the curved wall in its resting position and comprises a mating geometry configured to mate with the remaining regions of the curved wall and thereby enable the substantial optical isolation of the section of the path when in the resting position.

23. The system of claim 22, comprising a projection system having one or more projection devices and configured to project images onto the display surface and the curved wall.

* * * * *